US010571209B1

(12) United States Patent
Dagan

(10) Patent No.: US 10,571,209 B1
(45) Date of Patent: Feb. 25, 2020

(54) SAFETY MECHANISM RETROFITTABLE INTO EXISTING FIREARMS WITHOUT CHANGING EXTERNAL SHAPE OF FIREARM

(71) Applicant: Roy Dagan, Tel Mond (IL)

(72) Inventor: Roy Dagan, Tel Mond (IL)

( * ) Notice: Subject to any disclaimer, the term of this patent is extended or adjusted under 35 U.S.C. 154(b) by 0 days.

(21) Appl. No.: 16/286,641

(22) Filed: Feb. 27, 2019

(51) Int. Cl.
*F41A 17/44* (2006.01)
*F41A 17/32* (2006.01)

(52) U.S. Cl.
CPC ..... *F41A 17/44* (2013.01); *F41A 17/32* (2013.01)

(58) Field of Classification Search
CPC ..... F41A 17/00; F41A 17/066; F41A 17/44
USPC ..... 42/70.01, 70.11, 96
See application file for complete search history.

(56) References Cited

U.S. PATENT DOCUMENTS 2,327,334 A 8/1943 Parker
4,136,476 A * 1/1979 Hetrick ..... F41A 17/44 42/70.11
4,224,753 A * 9/1980 Bielman ..... F41A 17/44 42/70.11
5,048,211 A * 9/1991 Hepp ..... F41A 17/44 42/70.11
5,138,785 A * 8/1992 Paterson ..... F41A 17/44 42/66
5,233,777 A * 8/1993 Waterman, Jr. ..... F41A 17/44 42/70.11
5,289,653 A * 3/1994 Szebeni ..... F41A 17/44 42/70.11
6,098,330 A * 8/2000 Schmitt ..... F41A 17/066 382/145
6,202,336 B1 * 3/2001 Audino ..... F41A 17/44 42/70.11
6,223,566 B1 4/2001 Jamison
6,286,242 B1 * 9/2001 Klebes ..... F41A 17/066 42/70.01
6,320,975 B1 11/2001 Vieweg
6,374,527 B1 * 4/2002 Finardi ..... F41A 17/44 42/70.11
6,405,472 B1 * 6/2002 Dojcsak ..... F41A 17/44 42/70.01
6,412,207 B1 * 7/2002 Crye ..... F41A 17/02 42/70.01

(Continued)

FOREIGN PATENT DOCUMENTS

CN 2127952 Y 3/1993
FR 2815114 4/2002

*Primary Examiner* — Derrick R Morgan
(74) *Attorney, Agent, or Firm* — Mark M. Friedman

(57) ABSTRACT

A modular safety device configured for retrofitting a firearm, the firearm having a barrel including a muzzle and a chamber at a distal end of the barrel, the modular safety device comprising a blocking rod configured to fit inside the barrel including inside the chamber and to block entry of a cartridge into the chamber, the blocking rod having a lock configured to lockingly affix a locking portion of the lock to the barrel; and a biometric identification system integral to a proximal end of the blocking rod adjacent the muzzle and having a user interface surface accessible for a user to input biometric data of the user, wherein the safety device is configured to be within the firearm such that addition of the safety device to the firearm either does not alter an external shape of the firearm or merely juts slightly out of the muzzle.

30 Claims, 11 Drawing Sheets

(56) References Cited

U.S. PATENT DOCUMENTS 6,578,308 B2 6/2003 Hickerson
6,634,130 B1 * 10/2003 Balchunas ..... F41A 17/44 42/70.11
6,701,655 B2 * 3/2004 Milo ..... F41A 17/44 42/70.11
6,796,072 B2 9/2004 Barber et al.
6,862,831 B1 * 3/2005 Canaday ..... F41A 17/44 42/66
6,912,807 B2 * 7/2005 Meyerle ..... F41A 17/06 42/70.11
7,849,625 B2 * 12/2010 Ligard ..... F41A 17/44 42/70.01
7,921,588 B2 * 4/2011 Brown ..... G08B 15/00 42/114
8,677,668 B1 4/2014 Caldwell
8,918,900 B2 * 12/2014 Saito ..... G06K 19/0723 713/186
9,222,741 B2 * 12/2015 Koerner ..... F41A 17/42
10,024,615 B1 * 7/2018 Oh ..... F41C 33/0263
2002/0152662 A1 * 10/2002 Lane ..... F41A 17/44 42/70.11
2002/0174589 A1 * 11/2002 Rumfelt ..... F41A 17/063 42/70.11
2004/0074131 A1 * 4/2004 Meyerle ..... F41A 17/06 42/70.11
2007/0079540 A1 * 4/2007 Giebel ..... F41A 17/063 42/70.11
2009/0229159 A1 * 9/2009 Roth ..... F41A 17/44 42/70.01
2011/0119890 A1 * 5/2011 Steuwer ..... F41A 17/44 29/428
2011/0173860 A1 * 7/2011 Arendt ..... F41A 17/44 42/70.11
2015/0135571 A1 * 5/2015 Kohel, Sr. ..... F41A 17/44 42/70.11
2015/0241153 A1 * 8/2015 Mardirossian ..... F41A 17/08 42/70.11
2017/0241730 A1 * 8/2017 Ochoa ..... F41A 17/44
2017/0350667 A1 * 12/2017 Fishbein ..... F41A 17/44
2019/0003804 A1 * 1/2019 Deng ..... F41A 35/00
2019/0170482 A1 * 6/2019 Engelstein ..... F41G 3/2605

* cited by examiner

SAFETY MECHANISM RETROFITTABLE INTO EXISTING FIREARMS WITHOUT CHANGING EXTERNAL SHAPE OF FIREARM

FIELD AND BACKGROUND OF THE INVENTION

The invention relates to apparatuses and methods for rendering a firearm safe, and more particularly, to apparatuses and methods that include a safety device and that can be used for retrofitting existing firearms.

SUMMARY OF THE PRESENT INVENTION

One aspect of the present invention is a modular safety device configured for retrofitting a firearm, the firearm having a barrel including a muzzle and a chamber at a distal end of the barrel, the modular safety device comprising a blocking rod configured to fit inside the barrel including inside the chamber and to block entry of a cartridge into the chamber, the blocking rod having a lock configured to lockingly affix a locking portion of the lock to the barrel; and a biometric identification system integral to a proximal end of the blocking rod adjacent the muzzle and having a user interface surface accessible for a user to input biometric data of the user, wherein the safety device is configured to be within the firearm such that addition of the safety device to the firearm either does not alter an external shape of the firearm or does not alter the external shape other than by jutting out of the muzzle by up to 2 mms.

In certain embodiments, the blocking rod is extensible by telescoping so as to be adjustable to four or more lengths.

In certain embodiments, the blocking rod is extensible by telescoping so as to be adjustable to ten or more lengths.

In certain embodiments, the device further comprises a stopping means for preventing the blocking rod from entering too far into the barrel. In certain embodiments, the stopping means is a lip wider than the muzzle, the lip not thicker than 2 mms.

In certain embodiments, the blocking rod comprises a first rod and a second rod substantially coaligned with one another, a third rod extensible in length situated between, and attached to, the first and second rods. In certain embodiments, the third rod has sections that telescope within each other upon exertion of a lateral force against a proximal end of the blocking rod.

In certain embodiments, the user interface surface is substantially perpendicular to the longitudinal axis of the blocking rod and is substantially flush with a proximal end of the muzzle.

In certain embodiments, the locking portion is expandable in diameter from a non-locking position to a fully expanded locking position in which the locking portion firmly abuts an inner wall of the barrel, wherein the expansion is substantially perpendicular to a longitudinal axis of the blocking rod. In certain embodiments, the locking portion comprises an O-ring that firmly abuts the inner wall of the barrel using at least one of (i) a friction fit against the inner wall and (ii) a mating between the O-ring and a recess in the inner wall. In certain embodiments, an inner wall of the barrel has carved therein a circular recess configured to mate with the O-ring in the fully expanded locking position of the O-ring.

In certain embodiments, the biometric identification system includes a fingerprint sensor; a fingerprint storage unit; and a fingerprint identification processing unit in communication with the fingerprint storage unit and configured to transmit an instruction to the lock to unlock the lock upon authentication of the fingerprint, wherein the biometric data is a fingerprint. In certain embodiments, the blocking rod also comprises a communication element operatively engaged to the fingerprint identification processing unit and configured to transmit to a remote receiver at least one of (i) a status of the safety device and (ii) a copy of an inputted fingerprint and is configured to receive from a remote transmitter a fingerprint for storage in the safety device. In certain embodiments, the blocking rod also comprises a communication element operatively engaged to the fingerprint identification processing unit and configured to transmit to a remote receiver a status of at least one sensor at one or both ends of the blocking rod so as to monitor each instance in which a user unlocks or attempts to unlock the lock and to receive from a remote transmitter instructions concerning the monitoring. In certain embodiments, the fingerprint identification system includes a user interface that presents a user with the fingerprint screen in at least one mode. In certain embodiments, the fingerprint identification system includes a fingerprint identification processing unit and includes a communication unit configured to communicate with a positioning system and send an alert to a remote location if the firearm is moved away from a pre-defined location more than a pre-defined distance. In some embodiments, the user interface prompts a user to upload an inputted fingerprint to the fingerprint identification processing unit. In some embodiments, the safety device is configured to be within the firearm such that addition of the safety device to the firearm does not alter an external shape of the firearm.

In some embodiments, the invention is a firearm that includes any one of the devices previously described.

In some embodiments, the blocking rod is fixed in length and a length of the blocking rod matches a length of the barrel. In some embodiments, the user interface surface is substantially perpendicular to the longitudinal axis of the blocking rod and is substantially flush with a proximal end of the muzzle. In some embodiments, the locking portion is expandable in diameter from a non-locking position to a fully expanded locking position in which the locking portion firmly abuts an inner wall of the barrel, wherein the expansion is substantially perpendicular to a longitudinal axis of the blocking rod. In some embodiments, the locking portion comprises an O-ring that firmly abuts the inner wall of the barrel using at least one of (i) a friction fit against the inner wall and (ii) a mating between the O-ring and a recess in the inner wall. In some embodiments, an inner wall of the barrel has carved therein a circular recess configured to mate with the O-ring in the fully expanded locking position of the O-ring. In some embodiments, the biometric identification system includes: a fingerprint sensor; a fingerprint storage unit; and a fingerprint identification processing unit in communication with the fingerprint storage unit and configured to transmit an instruction to the lock to unlock the lock upon authentication of the fingerprint, wherein the biometric data is a fingerprint. In some embodiments, the blocking rod also comprises a communication element operatively engaged to the fingerprint identification processing unit and configured to transmit to a remote receiver at least one of (i) a status of the safety device and (ii) a copy of an inputted fingerprint and is configured to receive from a remote transmitter a fingerprint for storage in the safety device. In some embodiments, the blocking rod also comprises a communication element operatively engaged to the fingerprint identification processing unit and configured to transmit to a remote receiver a status of at least one sensor at one or both ends of the blocking rod so as to monitor each instance in which a user unlocks or attempts to unlock the lock and to receive from a remote transmitter instructions concerning the monitoring. In some embodiments, the fingerprint identification system includes a user interface that presents a user with the fingerprint screen in at least one mode. In some embodiments, the fingerprint identification system includes a fingerprint identification processing unit and includes a communication unit configured to communicate with a positioning system and send an alert to a remote location if the firearm is moved away from a predefined location more than a pre-defined distance. In some embodiments, the user interface prompts a user to upload an inputted fingerprint to the fingerprint identification processing unit. In some embodiments, the safety device is configured to be within the firearm such that addition of the safety device to the firearm does not alter an external shape of the firearm. In some embodiments, the invention is a firearm that includes the device as defined in any of the above versions.

In certain embodiments, the firearm is a revolver, wherein the barrel includes a cylinder at the distal end of the barrel, wherein the chamber is one of multiple chambers inside the cylinder, wherein the blocking rod is configured to fit inside a particular chamber of the multiple chambers at a time when the particular chamber is longitudinally substantially aligned with the barrel, wherein the blocking rod is configured to block entry of the cartridge into the particular chamber. In certain embodiments, the blocking rod is extensible by telescoping so as to be adjustable to four or more lengths. In certain embodiments, the blocking rod is extensible by telescoping so as to be adjustable to ten or more lengths. In some embodiments, the device further comprises a stopping means for preventing the blocking rod from entering too far into the barrel. In some embodiments, the stopping means is a lip wider than the muzzle, the lip not thicker than 2 mms. In some embodiments, the blocking rod comprises a first rod and a second rod substantially coaligned with one another, a third rod extensible in length situated between, and attached to, the first and second rods. In some embodiments, the third rod has sections that telescope within each other upon exertion of a lateral force against a proximal end of the blocking rod. In some embodiments, the user interface surface is substantially perpendicular to the longitudinal axis of the blocking rod and is substantially flush with a proximal end of the muzzle. In some embodiments, the locking portion is expandable in diameter from a non-locking position to a fully expanded locking position in which the locking portion firmly abuts an inner wall of the barrel, wherein the expansion is substantially perpendicular to a longitudinal axis of the blocking rod. In some embodiments, the locking portion comprises an O-ring that firmly abuts the inner wall of the barrel using at least one of (i) a friction fit against the inner wall and (ii) a mating between the O-ring and a recess in the inner wall. In some embodiments, an inner wall of the barrel has carved therein a circular recess configured to mate with the O-ring in the fully expanded locking position of the O-ring. In some embodiments, wherein the biometric identification system includes: a fingerprint sensor; a fingerprint storage unit; and a fingerprint identification processing unit in communication with the fingerprint storage unit and configured to transmit an instruction to the lock to unlock the lock upon authentication of the fingerprint, wherein the biometric data is a fingerprint. In some embodiments, wherein the blocking rod also comprises a communication element operatively engaged to the fingerprint identification processing unit and configured to transmit to a remote receiver at least one of (i) a status of the safety device and (ii) a copy of an inputted fingerprint and is configured to receive from a remote transmitter a fingerprint for storage in the safety device. In some embodiments, the blocking rod also comprises a communication element operatively engaged to the fingerprint identification processing unit and configured to transmit to a remote receiver a status of at least one sensor at one or both ends of the blocking rod so as to monitor each instance in which a user unlocks or attempts to unlock the lock and to receive from a remote transmitter instructions concerning the monitoring. In some embodiments, the fingerprint identification system includes a user interface that presents a user with the fingerprint screen in at least one mode. In some embodiments, the fingerprint identification system includes a fingerprint identification processing unit and includes a communication unit configured to communicate with a positioning system and send an alert to a remote location if the firearm is moved away from a predefined location more than a pre-defined distance. In some embodiments, the user interface prompts a user to upload an inputted fingerprint to the fingerprint identification processing unit. In some embodiments, the safety device is configured to be within the firearm such that addition of the safety device to the firearm does not alter an external shape of the firearm. In some embodiments, the blocking rod is fixed in length and a length of the blocking rod matches a length of the barrel. In some embodiments, the invention is a firearm that includes any version of the aforementioned versions of the device.

These and other features, aspects and advantages of the invention will become better understood with reference to the following drawings, descriptions and claims.

BRIEF DESCRIPTION OF THE DRAWINGS

Various embodiments are herein described, by way of example only, with reference to the accompanying drawings, wherein.

DETAILED DESCRIPTION OF THE INVENTION

Figure 2:
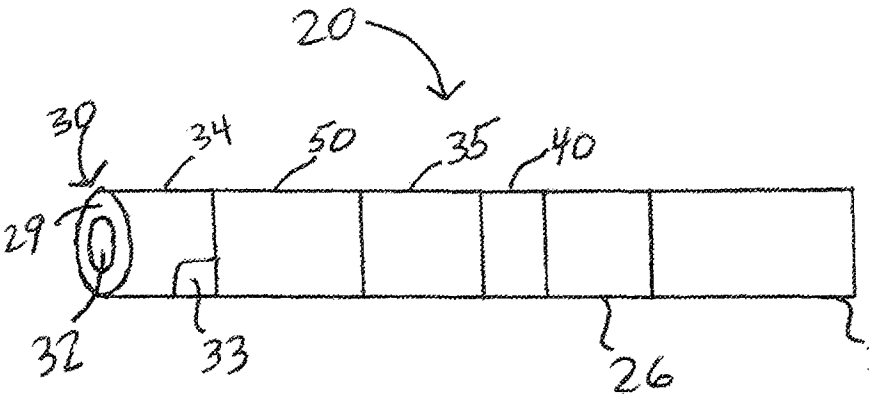
FIG. 2 is a schematic side view of a safety device unlocked, in accordance with an embodiment of the invention.

The following detailed description is of the best currently contemplated modes of carrying out the invention. The description is not to be taken in a limiting sense, but is made merely for the purpose of illustrating the general principles of the invention, since the scope of the invention is best defined by the appended claims.

The invention generally provides a safety device for firearms and in one embodiment comprises a modular safety device configured for retrofitting a firearm, the firearm having a barrel and having a chamber situated at the distal end of the barrel. In one embodiment, the modular safety device includes a blocking rod, which in one embodiment is extensible and in another embodiment is of fixed length, configured to be inserted into the barrel including inside the chamber. The blocking rod is configured to block entry of a cartridge into the chamber. The blocking rod has a lock configured to lockingly affix a locking portion of the lock to the barrel. In one non-limiting example of the implementation of the lock, the locking portion is expendable in diameter such as by using an O-ring that in its expanded position abuts an inner wall of the barrel. The safety device also includes a biometric identification system integral to a proximal end of the blocking rod adjacent the muzzle and having a surface, for example a user interface surface, that is accessible for a user to input biometric data of the user. In one embodiment, the user interface surface is substantially flush with the muzzle, for example with a proximal end of the muzzle. When the biometric input is authenticated by being matched against a previously stored biometric, a processor of the biometric identification system initiates an unlocking of the locking portion against an inner wall of the barrel. The processor initiates a locking of the safety device automatically when the user places the safety device in position within the firearm or after the user also inputs an instruction to the user interface for the processor to lock the device.

In certain embodiments, the safety device is insertable within the firearm and does not alter the outer shape of the firearm (or in other embodiments alters only the muzzle by the addition of a stopping means such as a lip of about or up to 1 mm or about or up to 2 mm in thickness) and therefore if the firearm needs to fit in a holster it can still fit in the holster even after the safety mechanism has been installed. In some embodiments, one can retrofit an existing firearm with this invention instead of having to have the manufacturer of the firearm re-design the firearm manufacturing process in order to incorporate the safety mechanism. The device is a modular add-on to the firearm as long as the firearm is in the same caliber. There are different size modular add-ons for different calibers. It applies to any firearm that has a chamber and a barrel with the exception of a revolver, and therefore it applies to both single shot, semi-automatic and fully automatic firearms. The invention applies also to rifles and assault weapons where the barrel can be as long as 30 centimeters or more. In a further embodiment shown in FIG. 6 and described herein the invention also applies to revolvers.

Certain embodiments of the invention have advantages over prior art safety devices that merely prevent access to the trigger to prevent the user from squeezing the trigger, which would not prevent the user from manually putting a cartridge into chamber and cocking the firearm. Certain embodiments of the invention also have advantages over a safety device that interferes with the magazine of the firearm such that the cartridge cannot move from the magazine into the chamber—in these embodiments of the invention the external shape is not altered nor is it necessary to re-design the manufacturing process for the firearm. Rather the device is a modular add-on usable to retrofit existing firearm and can be sold as such or as part of a combination with the firearm. Furthermore, use of the biometric input for authentication and unlocking of the safety device in certain embodiments of the invention the invention does not require a lot of time, unlike prior art devices that require a physical key that may have to be located (since typically security reasons dictate storage of the key remote from the firearm). This is important since activating a firearm is frequently something where time is of the essence.

Furthermore, in certain embodiments of the invention, safety device 10 itself authenticates the user and no other device external to the safety device is needed to control or implement this authentication. Furthermore, in certain embodiments, power source 35 is also situated within blocking rod 20 of device 10 and no external power source is needed to operate device 10. This advantage may be crucial in emergency situations where the firearm 80 is needed quickly and makes device 10 more efficient. Furthermore, it allows the combination of the firearm 80, the device 10 and everything needed to implement the device 10 to be stored in existing holsters.

The principles and operation of a Safety Mechanism Retrofittable into Existing Firearms Without Changing an External Shape of the Firearm may be better understood with reference to the drawings and the accompanying description.

Figure 1:
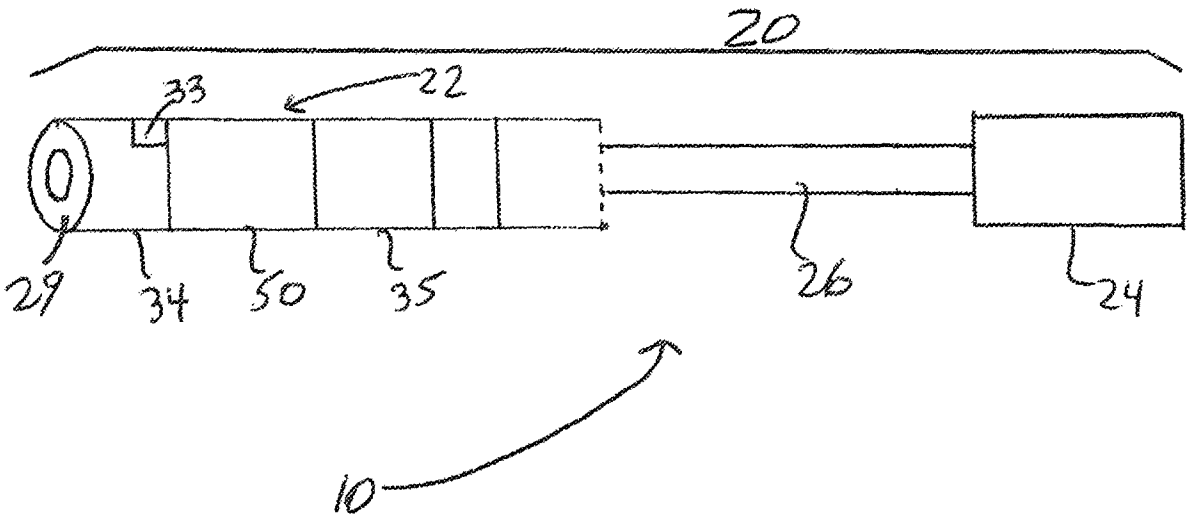
FIG. 1 is a schematic side view of the safety device for a firearm in an extended and unlocked position, in accordance with an embodiment of the invention.

In embodiments shown in FIGS. 1-6, the invention is a modular safety device 10 for a firearm 80. The modular safety device 10 is configured for retrofitting a firearm 80, the firearm 80 having a barrel 90, the barrel 90 having a muzzle 92, and having a chamber 95 at the distal end of the barrel 90. Modular safety device 10 comprises a blocking rod 20. In one embodiment the blocking rod 20 is extensible and is adjustable to many different positions for example four or more or eight or more or ten or more positions. FIG. 1 represents a blocking rod that can be fixed or extendible. If blocking rod 20 shown in FIG. 1 is an extensible rod, then rod 20 is at a position before extension to its desired length (FIG. 1). FIG. 2 show a blocking rod 20. The blocking rod of FIG. 2 is either a fixed length blocking rod 20 or is an extensible blocking rod 20 in a non-extended position. The non-extended position can be before expansion or it can be after compression. In either case, whether rod 20 of FIG. 2 is extensible or not and regardless of how it is extensible, device 10 has an unlocked position (FIG. 1 or FIG. 2) and a locked position (FIG. 3B). FIG. 3B shows the locked position of blocking rod 20 inside the firearm 80 in broken lines.

In any embodiment herein, blocking rod 20 is rigid enough to resist the insertion of a cartridge into barrel 90 and particularly into the chamber 95 of barrel 90.

Figure 3A:
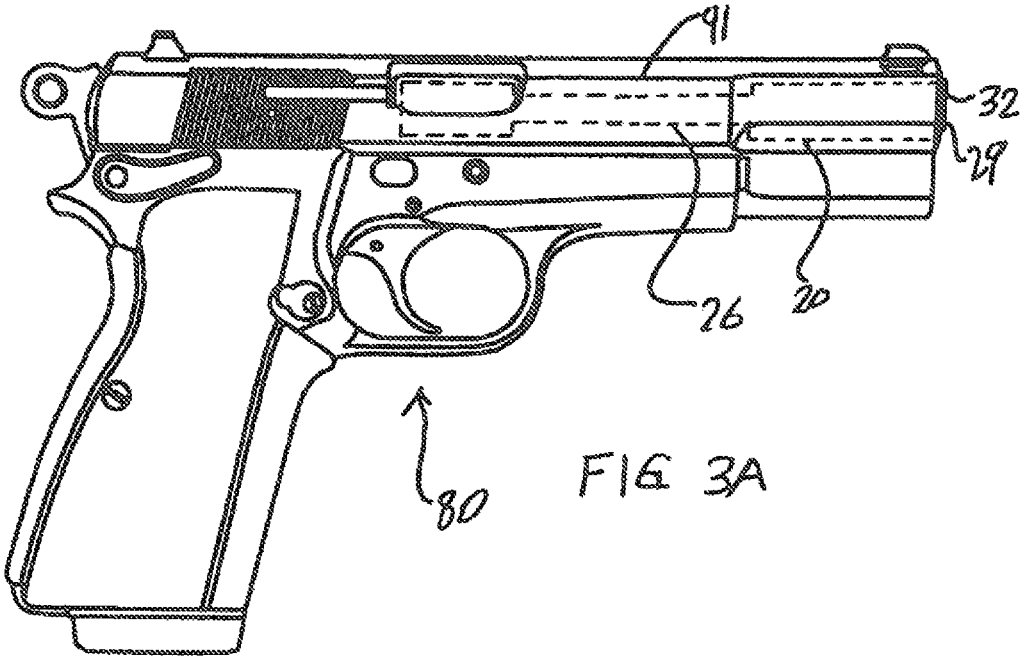
FIG. 3A is a side view of a firearm showing the safety device of FIG. 2 in unlocked position, in accordance with an embodiment of the invention.
Figure 3B:
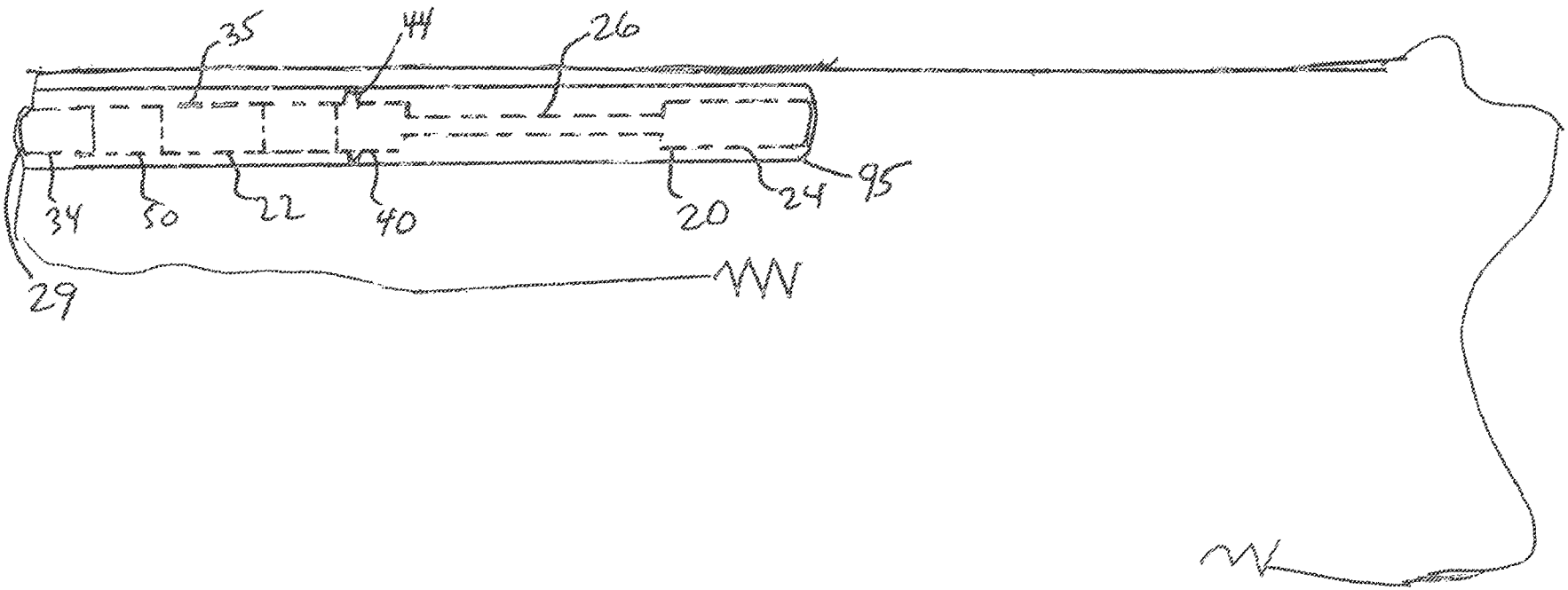
FIG. 3B is a side view of a broken away portion of a firearm showing the safety device of FIG. 2 in locked position, in accordance with an embodiment of the invention.

In one embodiment, safety device 10 is configured to fit inside the barrel 90 including by occupying the chamber 95 and to block entry of a cartridge into the chamber 95 of barrel 90. In that case, the blocking rod 20 has a lock or lock mechanism 40 configured to lockingly affix a locking portion 44 of the lock 40 to the barrel 90 or to the chamber 95 of firearm 80. FIG. 3A and FIG. 3B show locking portion 44 of 40 affixed to the barrel 90 of firearm 80.

Safety device 10 may also comprise a biometric identification system 30 integral to a proximal end of the blocking rod 20, the proximal end of rod 20 being adjacent the muzzle 92 of firearm 80 in certain embodiments. Blocking rod 20 may also have a surface 29, for example a user interface surface 29 that also be a proximal surface 29, that is accessible to a user in that the user is able to input the user's biometric data, such as a fingerprint, to the biometric identification system, such as a fingerprint identification system 30. For convenience of the user, the user interface surface 29 may be substantially perpendicular to the longitudinal axis of the blocking rod 20.

One way of implementing this is to have the user interface surface 29 of blocking rod 20 be substantially flush with the proximal edge of muzzle 92 for a user to input the biometric data of the user. In certain embodiments, surface 29 of rod 20 is flush with the edge of muzzle 92. In other embodiments, surface 29 of rid 20 is almost flush with the edge of muzzle 92 in that surface 29 is up to a millimeter from (and distal to) the proximal edge of muzzle 92 (i.e. buried within the barrel 90). In still other embodiments, surface 29 of rod 20 is almost flush with the edge of muzzle 92 in that surface 29 is up to 1.5 millimeters from the proximal edge of muzzle 92.

In some embodiments, safety device 10 is configured to be within the firearm 80 such that addition of the safety device 10 to the firearm 80 does not alter an external shape of the firearm. In another embodiment, addition of device 10 into firearm 80 does not alter the external shape of firearm 80 other than by the device 10 jutting out of the muzzle 92 slightly along the longitudinal axis of barrel 90 and of rod 20. In some versions, "slightly" means by up to 1 mm. In other versions, "slightly" means by up to 1.5 mms, or in other cases by up to 2 mms in length along the longitudinal axis of the barrel 90 (and of the blocking rod 20).

Figure 7A:
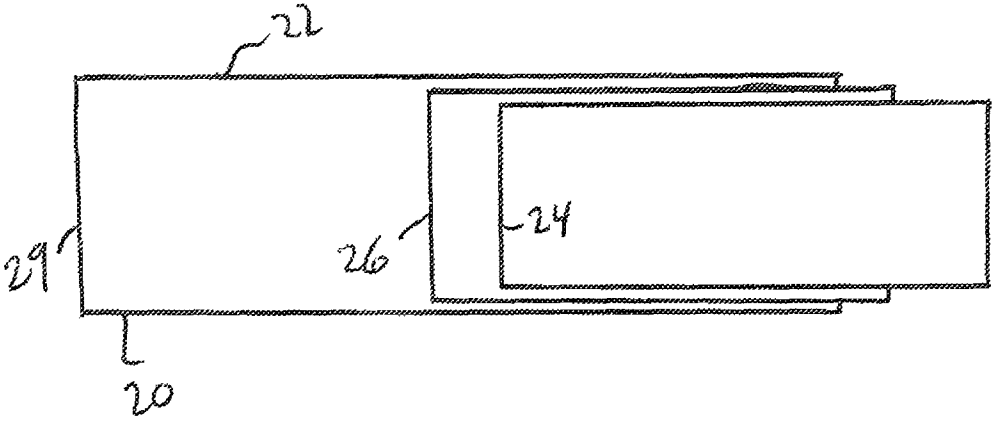
FIG. 7A shows one structure configured to adjust a length of the blocking rod of a safety device in accordance with an embodiment of the invention.
Figure 7B:
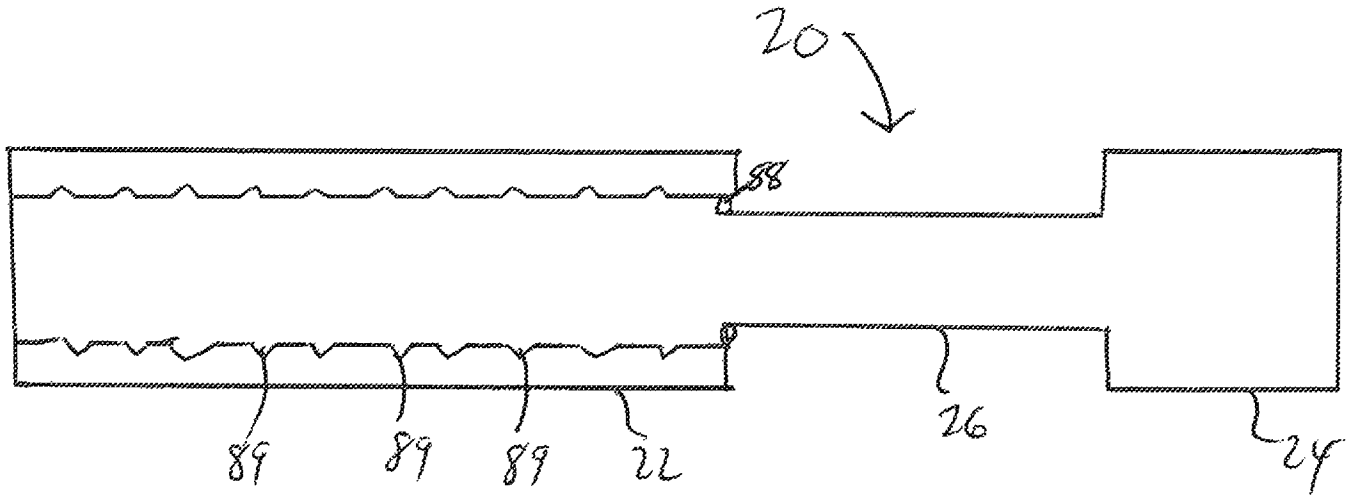
FIG. 7B shows a further structure configured to adjust a length of the blocking rod of a safety device in accordance with an embodiment of the invention.

As shown in FIG. 1, in some embodiments, the blocking rod 20 comprises a first rod 22 and a second rod 24 substantially coaligned with one another, and a third rod 26 extensible in length and situated between, and attached to, the first and second rods 22, 24. The extensible feature of the third rod 26 is implemented in some embodiments such that third rod 26 has sections that telescope within each other upon exertion of a lateral force against a proximal end of the blocking rod 20. One non-limiting version of this telescoping is shown in FIG. 7A. Although FIG. 7A depicts three sections (rods 22, 24, 26) in some versions, a telescoping spring is used wherein the number of sections is far more than three. In another non-limiting version shown in FIG. 7B, third rod 26 travels within for example first rod 22 as a result of a mini-wheels 88 (or alternatively pins) connected to third rod 26 on opposite sides of the rod 26 become embedded in one of a series of recesses or grooves 89 scattered throughout the length of an inner wall of first rod 22. Depending on what length is desired for blocking rod 20, the user pushes rod 20 laterally by exerting a lateral force on first rod 22 after device 10 is inserted into barrel 90 of firearm 80.

Figure 7C:
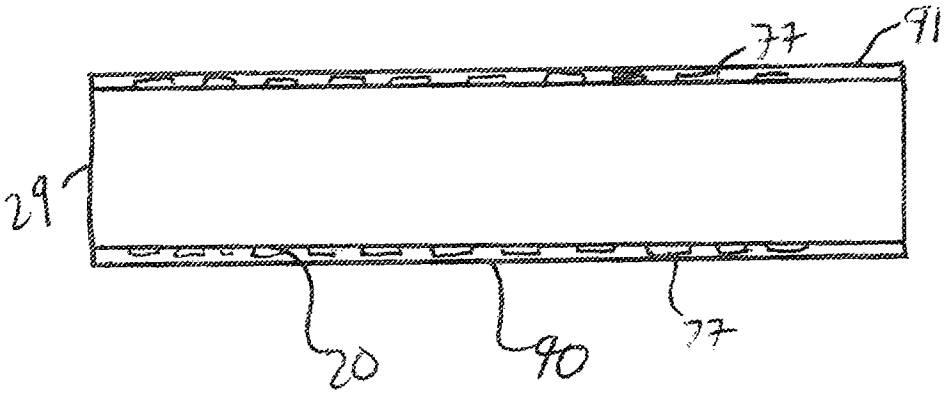
FIG. 7C shows a further structure configured to adjust a length of the blocking rod of a safety device in accordance with an embodiment of the invention.

In another implementation, as shown in FIG. 7C, each side of blocking rod 20 has a number of magnets 77 along the length of rod 20 and projecting outwardly perpendicular to the longitudinal axis of rod 20. Barrel 90 of firearm 80 including its inner wall 91 are typically metal. The user interface 29 actuates a particular magnet or magnets when the user is prompted to select a length of blocking rod 20. This mechanism may also exist in the version in which rod 20 is telescoping.

However, in embodiments in which blocking rod 20 is of fixed length, rod 26 can be a fixed length third rod 26. As seen in FIG. 3B, one implementation of the lock mechanism 40 is that the locking portion 44 of lock 40 is expandable in diameter from a non-locking position shown in FIG. 2 (wherein locking portion 44 is not visible since it is flush to an outer wall of rod 20) to a fully expanded locking position shown in FIG. 3B in which the O-ring projects beyond the outer wall of rod 20 and firmly abuts an inner wall 91 of barrel 90. The expansion of locking portion 44 is in certain embodiments in a direction that is substantially perpendicular to a longitudinal axis of the blocking rod 20 and to the outer wall of rod 20. The expansion of locking portion 44 may occur at any suitable portion of the length of barrel 90 including at chamber 95.

In one implementation of the locking portion 44, an O-ring 44 is expandable in diameter from the non-locking position shown in FIG. 2 to the fully expanded locking position shown in FIG. 3B.

In some variants, the O-ring firmly abuts inner wall 91 of the barrel 90 using at least one of (i) a friction fit against the inner wall and (ii) a mating between the O-ring and a recess in the inner wall. In the case of a mating between O-ring 44 and a recess in the inner wall 91 of barrel 90 there can be multiple recesses depending on the length of the barrel 90. This is because in some embodiments of the invention device 10 is designed for firearms of different lengths such that a particular thickness device 10 would retrofit a particular caliber firearm 80 regardless of the length of the barrel 90 of the firearm 80. For example, the extendible rod 26 is configured in some embodiments to vary from a centimeter to 12 centimeters to be able to adapt to different length firearms.

The O-ring, in some embodiments, is implemented wherein an inner wall of the barrel has carved therein a circular recess configured to mate with the O-ring in the fully expanded locking position of the O-ring.

In another implementation of locking portion 44, the user interface surface 29 is an actuator that, when actuated, mechanically forces locking portion 44 to be urged outward (or electrically induces locking portion 44 to be urged outward) until locking portion abuts inner wall 91 of barrel 90.

In some embodiments, the biometric identification system 30 comprises a fingerprint identification system 30 that includes a fingerprint sensor 32. Sensor 32 can be implemented as a fingerprint screen 32 that the user presses their fingerprint against. Fingerprint identification system 30 may also comprise a fingerprint storage unit 33 and a fingerprint identification processing unit 34 that is in communication with the biometric (i.e. fingerprint) storage unit 33. Processing unit 34 is in some embodiments configured to transmit an instruction to the lock mechanism 40 to unlock the lock 40 or to lock the lock 40 upon authentication of the fingerprint (or other biometric).

FIG. 1 shows that in certain non-limiting embodiments blocking rod 20 includes from left (proximal end) to right (distal end) a biometric sensor 32, a printed circuit board as one implementation of the biometric identification processing unit 34, a power source 35, a locking portion 44 of lock mechanism 40 and a dummy cartridge 37 configured to occupy either the distal end of the barrel 90 or the chamber 95. The order of components described may also be varied to effectuate the purpose stated herein.

Blocking rod 20 may be cylindrical or may be in the shape of the hollow of the barrel 80. In that case, blocking rod 20 may have a width, for example a diameter that is slightly smaller than the width, for example the inner diameter of inner wall 91 of barrel 90.

Device 10, in some embodiments, has additional functionality that provides benefits. For example, blocking rod 20 in some cases also comprises a communication element 50 operatively engaged to the biometric (i.e. fingerprint) identification processing unit 34 and configured to transmit to a remote receiver at least one of (i) a status of the safety device 10 and (ii) a copy of an inputted fingerprint and to receive from a remote receiver a copy of a biometric such as a fingerprint to store in device 10.

In other embodiments, blocking rod 20 comprises a communication element 50 operatively engaged to the biometric (i.e. fingerprint) identification processing unit 34 and configured to transmit to a remote receiver a status of at least one sensor (sensors 132, 133 shown illustratively in FIG. 5B) at one or both ends of the blocking rod 20 so as to monitor each instance in which a user unlocks or attempts to unlock (or remove) the lock 40. In countries where the soldier sometimes goes home for the week-end, a soldier for example may be authorized to take his firearm home with him for the week-end but also instructed not to use it during the week-end. This needs to be monitored. Similarly, when the soldier is after training hours or off duty while in service the solider has instructions not to use the firearm. Furthermore, other individuals besides the authorized user of the firearm can try to tamper with the firearm by improperly trying to open the lock. The invention allows, in certain embodiments, communication to a remote location each time anyone released the lock. This data would then be reviewable remotely by the soldier's superiors. The remote location can be a mobile phone or device, a computer or another suitable point.

In some embodiments, the invention is operatively engaged to a positioning system such that if the biometric (i.e. fingerprint) identification system 30's biometric (i.e. fingerprint) identification processing unit 34 has a communication unit 50 configured to communicate with the positioning system, the communication unit can be configured to send an alert to a remote location if (or whenever) the firearm 80 is moved away from a pre-defined location more than a pre-defined distance.

In some embodiments, biometric (i.e. fingerprint) identification system 30 includes a user interface 29 that presents a user with the fingerprint screen 32 in at least one mode. Modes can be changed by pressing or otherwise interacting with sensor 32, which may be screen 32. In one mode, the user interface 29 presents a screen 32 for imprinting or otherwise inputting a fingerprint or other biometric identifier (sometimes called a biometric). The inputting of the fingerprint or other biometric occurs initially to set the definition of the "model" biometric (i.e. fingerprint) defining who is allowed to unlock the device and also occurs at a later time when a user inputs his or her biometric in order to be authenticated. Accordingly, the user interface has a prompt that allows the user to choose sending a biometric to storage 33 as the model biometric for a future comparison as well as a function of sending a biometric for immediate comparison with the previously stored model biometric.

In another mode the user interface 29 presents a different type of screen or interface that prompts the user to send instructions to processing unit 34 to send a biometric to a remote location or to send an updated status of the position or other status of the device 10 to a remote location. Other variants suitable for the purpose can include pressing on different parts of the screen 32 to activate different modes or providing a colored LED light behind screen 32 such that a particular colored light is associated with a particular mode of the user interface. Typically, the capability of communications between communication element 50 and a remote device is bi-directional"to" and "from" the safety device. Another embodiment of the invention is the combination of a firearm with device 10 and this applies to any embodiment of device 10.

In embodiments in which blocking rod 20 is of fixed length, the length of blocking rod 20 may be tailored in length to match the length of the barrel 90 of the firearm 90. Since different firearms 80 having different barrels 90 may have different lengths, for fixed length blocking rods, there would need to be different product models of device 10. For firearms used in national (or other) armed forces in which the length of the firearm 80 and of the barrel 90 of the firearm 80 may be standard or may vary among only a small number of firearm types, device 10 may be configured in length to correspond to a particular model firearm 80. This may favor use of the embodiment of device 10 having a fixed length blocking rod 20.

In this case, device 10 comprises a fixed length blocking rod 20 configured to fit inside the barrel including the chamber and to block entry of a cartridge into the chamber, the blocking rod having a lock 40 configured to lockingly affix a locking portion 44 of the lock to the barrel or to the chamber.

Figure 4A:
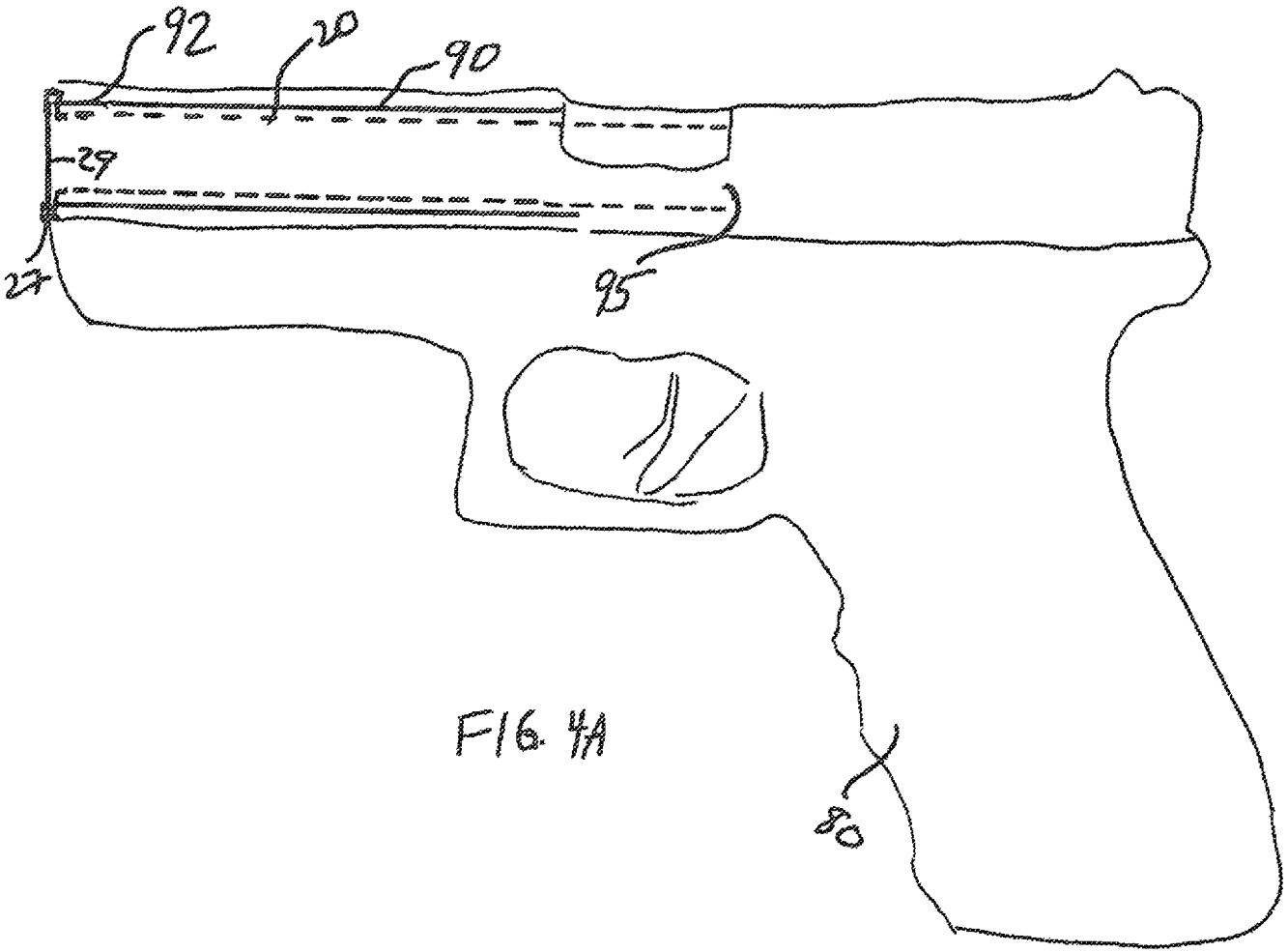
FIG. 4A is a schematic side view of a firearm showing a safety device in an unlocked position, in accordance with a further embodiment of the invention.
Figure 4B:
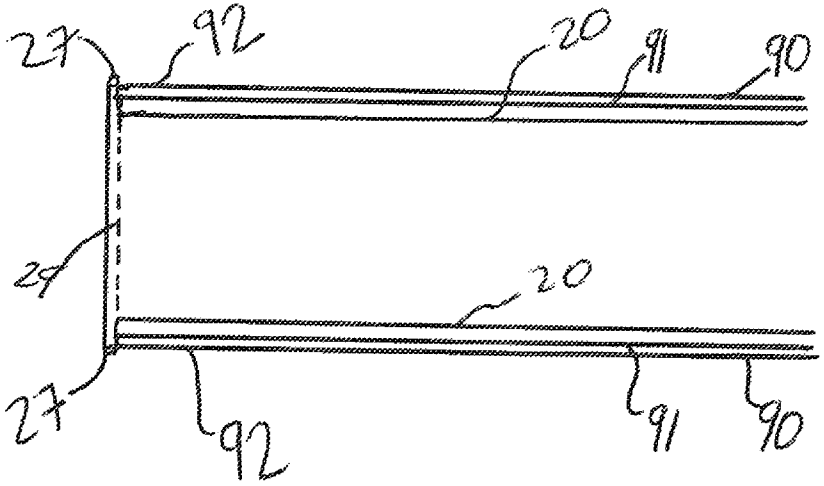
FIG. 4B is a schematic side view of part of a barrel of a firearm showing part of a safety device including a stopping means of a blocking rod, in accordance with an embodiment of the invention.

As seen in FIG. 4A and FIG. 4B, the proximal end of the blocking rod 20 may have a stopping means 27 that prevents insertion of device 10 too far into the barrel 90 to the point where a user cannot readily access the biometric identification system 30 or the user interface 29. In one implementation, stopping means 27 is a lip 27 wider than the muzzle 92. In some embodiments, lip 27 is not thicker than 2 mms. Lip 27 is included in certain embodiments of the invention because if a fixed length blocking rod 20 of device 10 did not include lip 27 such blocking rod 20 can be inserted too far into the barrel 90 of firearm 80 such that even the proximal end of such blocking rod 20 is so far into the muzzle 92 that a user cannot input the user's biometric data, such as a fingerprint, into the biometric identification system of the firearm 80, which biometric identification system is typically located at the proximal end of the blocking rod 20. The stopping means 27, which may be a lip 27, would be a possible version in a case where the blocking rod 20 includes an extensible element (for example an intermediate telescoping third rod 26 as shown in the embodiment of FIGS. 1-3) because in that case there is a concern that device can be inserted too far into barrel 90 due to the adjustment of the length of blocking rod 20. With the presence of stopping means 27, blocking rod 20 cannot enter so far into barrel 90 to be inaccessible to the user.

In use, a user would push the blocking rod 20 into the barrel until the blocking rod 20 reaches into the chamber 95, since the opening to the chamber 95 (adjacent the barrel 90) is not narrower than barrel 90 Safety device 10 is configured to be within the firearm such that addition of the safety device to the firearm either does not alter an external shape of the firearm or else alters the external shape of the firearm only at the proximal end of the barrel 90 by the lip 27 sticking out of the firearm along a longitudinal axis of the barrel 90 by an amount not exceeding 2 mms. The thickness limitation is to prevent someone from using a tool to grip the lip 27 to forcibly remove device 10 from barrel 90. In some embodiments, the thickness of lip 27 is only 1 mm. and sticks out only 1 mm. In some embodiments, lip 27 sticks out of muzzle 92 by up to 1 mm or alternatively by up to 1.5 mm. As shown in FIG. 4, lip 27 should also not extend excessively in a direction perpendicular to the longitudinal axis of barrel 90.

Furthermore, another embodiment of the invention is a firearm that includes the device in any embodiment.

Figure 5A:
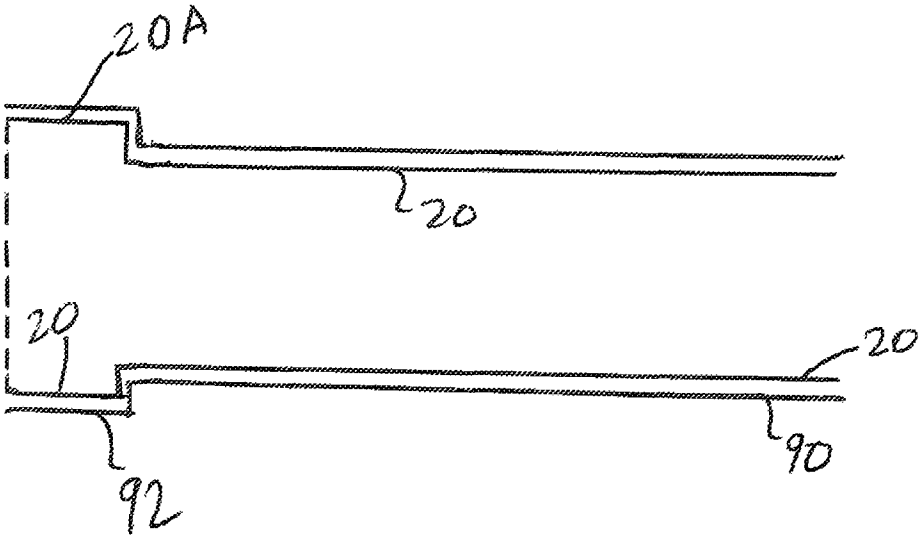
FIG. 5A is a schematic showing a partial side view of a blocking rod having a wide proximal end occupying a wide proximal end and muzzle of a long firearm, in accordance with an embodiment of the invention.
Figure 5B:
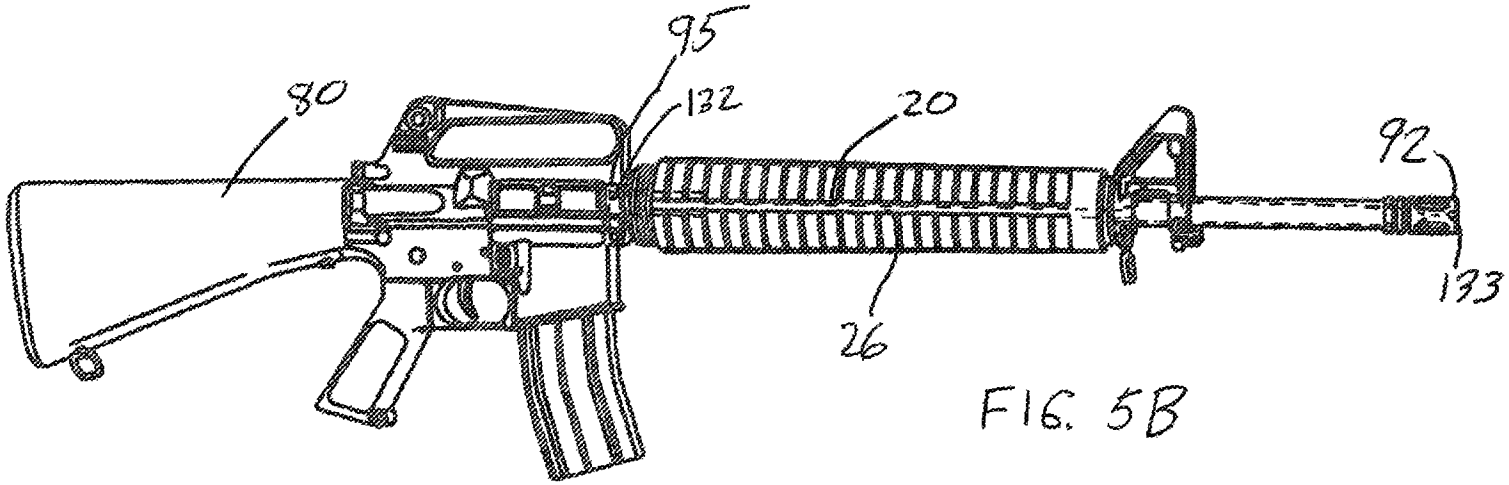
FIG. 5B is a side view of a rifle having a safety device within the rifle and including sensors, in accordance with an embodiment of the invention.

Large firearms often are designed with a wider muzzle to hide the fire that emerges from the barrel. FIG. 5A and FIG. 5B show blocking rod 20 containing a biometric (for example fingerprint) sensor 32 within a long firearm 80 (whether automatic, semi-automatic or single shot) having a wide muzzle such that a wider proximal section 20A of rod 20 matches in shape and occupies the wider proximal section of the muzzle 92 of barrel 90. The greater cross-section of the proximal section 20A of rod 20 containing the biometric identification system 30 allows for the biometric (for example fingerprint) identification processing unit 34 (for example a printed circuit board) to have a wider cross-section and thereby carry more functionality.

Figure 6:
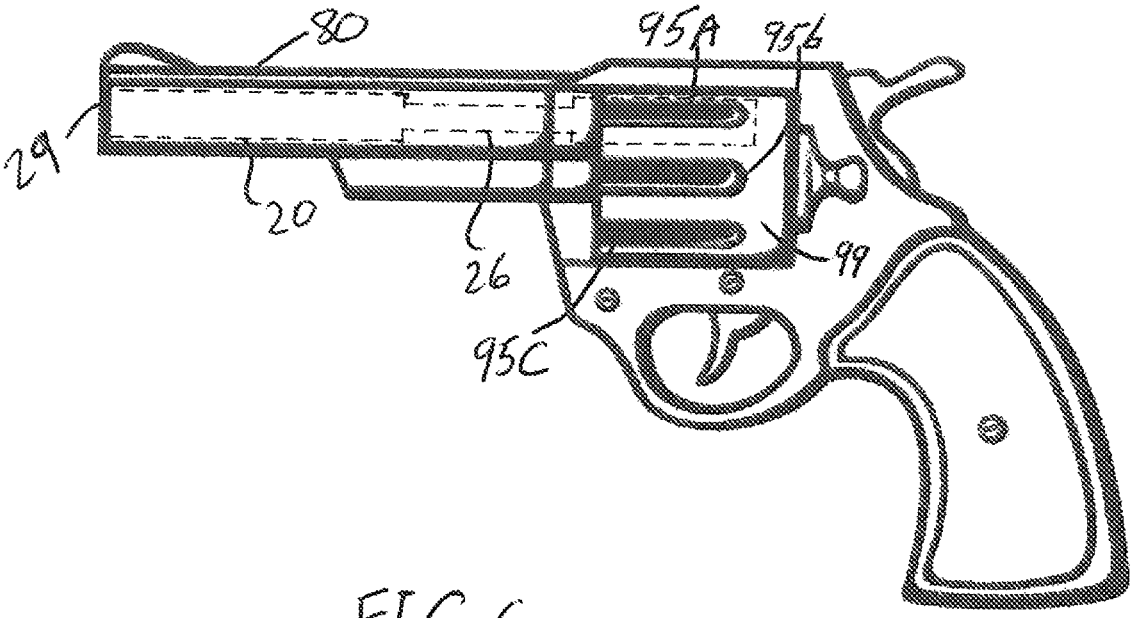
FIG. 6 shows a side view of a revolver including the safety device embedded therein, accordance with one embodiment of the invention.

In embodiments of device 10 configured to be placed inside a firearm 80 that is a revolver, as shown in FIG. 6, barrel 90 includes a cylinder 99 at the distal end of the barrel 90, wherein the chamber 95 is one of multiple chambers 95*a*, 95*b*, 95*c*, etc. inside the cylinder 99, wherein the blocking rod 20 is configured to fit inside a particular chamber 95 of the multiple chambers 95*a*, 95*b*, 95*c*, etc. at a time when the particular chamber 95 is longitudinally substantially aligned with the barrel. In that case, blocking rod 20 is configured to block entry of the cartridge into the particular chamber.

While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. A modular safety device configured for retrofitting a firearm, the firearm having a barrel including a muzzle and a chamber at a distal end of the barrel, the modular safety device comprising:

a blocking rod configured to fit inside the barrel including inside the chamber and to block entry of a cartridge into the chamber, the blocking rod having a lock configured to lockingly affix the blocking rod to the barrel; and a biometric identification system integral to a proximal end of the blocking rod adjacent the muzzle, configured to fit inside the muzzle and having a user interface surface comprising (i) a fingerprint sensor flush with or at a proximal tip of the proximal end of the muzzle, for inputting a fingerprint of the user, and (ii) a fingerprint identification processing unit configured to transmit an instruction to the lock to unlock the lock upon authentication of the fingerprint, wherein the safety device is configured to be within the firearm such that addition of the safety device to the firearm does not alter an external shape of the firearm.

2. The safety device of claim 1, wherein the blocking rod is extensible by telescoping so as to be adjustable to four or more lengths.

3. The safety device of claim 1, wherein the blocking rod is extensible by telescoping so as to be adjustable to ten or more lengths.

4. The safety device of claim 1, further comprising a stopping means for preventing the blocking rod from entering too far into the barrel.

5. The safety device of claim 4, wherein the stopping means is a lip wider than the muzzle, the lip not thicker than 2 mms.

6. The safety device of claim 1, wherein the blocking rod comprises a first rod and a second rod substantially coaligned with one another, a third rod extensible in length situated between, and attached to, the first and second rods.

7. The safety device of claim 6, wherein the third rod has sections that telescope within each other upon exertion of a force against a proximal end of the blocking rod, the force exerted along a longitudinal axis of the blocking rod.

8. The safety device of claim 1, wherein the fingerprint sensor is flush with a proximal end of the muzzle.

9. The safety device of claim 1, wherein the lock is expandable in diameter from a non-locking position to a fully expanded locking position in which the lock firmly abuts an inner wall of the barrel, wherein the expansion is substantially perpendicular to a longitudinal axis of the blocking rod.

10. The safety device of claim 9, wherein the lock comprises an O-ring that firmly abuts the inner wall of the barrel using at least one of (i) a friction fit against the inner wall and (ii) a mating between the O-ring and a recess in the inner wall.

11. The safety device of claim 1, wherein the user interface surface in one mode prompts inputting a fingerprint on a fingerprint screen and in another mode prompts sending the fingerprint for storage.

12. The safety device of claim 1, wherein the fingerprint sensor comprises a fingerprint screen configured to receive the fingerprint of the user when the user presses a finger of the user against the fingerprint screen.

13. The safety device of claim 1, wherein the blocking rod also comprises a communication element operatively engaged to the fingerprint identification processing unit and configured to transmit to a remote receiver at least one of (i) a status of the safety device and (ii) a copy of an inputted fingerprint and is configured to receive from a remote transmitter fingerprint data for storage in the safety device.

14. The safety device of claim 1, wherein the blocking rod also comprises a communication element operatively engaged to the fingerprint identification processing unit and configured to transmit to a remote receiver a status of at least one sensor at one or both ends of the blocking rod so as to monitor each instance in which a user unlocks or attempts to unlock the lock and to receive from a remote transmitter instructions concerning the monitoring.

15. The safety device of claim 1, wherein the biometric identification system also includes a fingerprint storage unit in communication with the fingerprint identification processing unit.

16. The modular safety device of claim 1, wherein the fingerprint identification system includes a communication unit configured to communicate with a positioning system and send an alert to a remote location if the firearm is moved away from a pre-defined location more than a pre-defined distance.

17. The device of claim 1, wherein the user interface surface is configured to prompt the user to upload an inputted fingerprint to the fingerprint identification processing unit.

18. The device of claim 1, wherein the fingerprint screen is substantially perpendicular to the longitudinal axis of the blocking rod.

19. A firearm that includes the device of claim 1.

20. The device of claim 1, wherein the blocking rod is fixed in length and a length of the blocking rod matches a length of the barrel.

21. The device of claim 20, wherein the user interface surface is substantially perpendicular to the longitudinal axis of the blocking rod and is substantially flush with a proximal end of the muzzle.

22. The safety device of claim 20, wherein the lock is expandable in diameter from a non-locking position to a fully expanded locking position in which the lock firmly abuts an inner wall of the barrel, wherein the expansion is substantially perpendicular to a longitudinal axis of the blocking rod.

23. The safety device of claim 20, wherein the lock comprises an O-ring that firmly abuts the inner wall of the barrel using at least one of (i) a friction fit against the inner wall and (ii) a mating between the O-ring and a recess in the inner wall.

24. The safety device of claim 20, wherein the biometric identification system includes:

a fingerprint storage unit; and the fingerprint identification processing unit is in communication with the fingerprint storage unit.

25. The safety device of claim 24, wherein the blocking rod also comprises a communication element operatively engaged to the fingerprint identification processing unit and configured to transmit to a remote receiver at least one of (i) a status of the safety device and (ii) a copy of an inputted fingerprint and is configured to receive from a remote transmitter a fingerprint for storage in the safety device.

26. The safety device of claim 24, wherein the blocking rod also comprises a communication element operatively engaged to the fingerprint identification processing unit and configured to transmit to a remote receiver a status of at least one sensor at one or both ends of the blocking rod so as to monitor each instance in which a user unlocks or attempts to unlock the lock and to receive from a remote transmitter instructions concerning the monitoring.

27. The safety device of claim 24, wherein the biometric identification system includes a user interface that presents a user with a fingerprint screen in at least one mode.

28. The modular safety device of claim 24, wherein the biometric identification system includes a fingerprint identification processing unit and includes a communication unit configured to communicate with a positioning system and send an alert to a remote location if the firearm is moved away from a pre-defined location more than a pre-defined distance.

29. The device of claim 20, wherein the safety device is configured to be within the firearm such that addition of the safety device to the firearm does not alter an external shape of the firearm.

30. The modular safety device of claim 1, wherein the chamber is one of multiple chambers, wherein the blocking rod is configured to fit inside a particular chamber of the multiple chambers at a time when the particular chamber is longitudinally substantially aligned with the barrel, wherein the blocking rod is configured to block entry of the cartridge into the particular chamber.

* * * * *